US010994318B2

(12) United States Patent
Riches

(10) Patent No.: US 10,994,318 B2
(45) Date of Patent: May 4, 2021

(54) SLIDING TRANSPORT OF ROLLED PRODUCT WITH ADAPTATION OF FRICTION

(71) Applicant: Primetals Technologies Germany GmbH, Erlangen (DE)

(72) Inventor: Paul Barry Riches, Paxton, MA (US)

(73) Assignee: PRIMETALS TECHNOLOGIES GERMANY GMBH, Erlangen (DE)

( * ) Notice: Subject to any disclaimer, the term of this patent is extended or adjusted under 35 U.S.C. 154(b) by 886 days.

(21) Appl. No.: 15/538,017

(22) PCT Filed: Dec. 30, 2014

(86) PCT No.: PCT/US2014/072672
§ 371 (c)(1),
(2) Date: Jun. 20, 2017

(87) PCT Pub. No.: WO2016/108830
PCT Pub. Date: Jul. 7, 2016

(65) Prior Publication Data
US 2017/0361366 A1 Dec. 21, 2017

(51) Int. Cl.
*B21B 43/00* (2006.01)
*B21B 39/00* (2006.01)
(Continued)

(52) U.S. Cl.
CPC ..... *B21B 43/003* (2013.01); *B21B 1/08* (2013.01); *B21B 39/006* (2013.01); *B21B 1/16* (2013.01)

(58) Field of Classification Search
CPC ..... B21B 1/08; B21B 1/16; B21B 39/006; B21B 43/003
See application file for complete search history.

(56) References Cited

U.S. PATENT DOCUMENTS 3,236,084 A 2/1966 Kato
3,972,402 A * 8/1976 Karlberger ..... B21B 43/003 193/35 A
6,257,034 B1 * 7/2001 Fukumori ..... B21B 1/26 72/201

FOREIGN PATENT DOCUMENTS

CN 103203374 A 7/2013
JP 55-42770 3/1980
(Continued)

OTHER PUBLICATIONS

Chinese Office Action dated Jun. 25, 2018 in corresponding Chinese Patent Application No. 201480084476.6, 5 pgs.
(Continued)

*Primary Examiner* — Teresa M Ekiert
(74) *Attorney, Agent, or Firm* — Staas & Halsey LLP

(57) ABSTRACT

A pinch roll delivers a respective rolled product. A control device opens the pinch roll at a respective trigger time and at a respective transport speed of the respective rolled product. The control device determines the respective trigger time and/or the respective transport speed using a model that depends on a coefficient of friction. After opening the pinch roll, a measuring device detects iteratively a position or a derivation in time of the position of the respective rolled product. The detected positions or the detected derivations in time of the position are provided to the control device. The control device in dependency on the positions or the derivations in time of the position updates the coefficient of friction and uses the updated coefficient of friction for determining the respective trigger time and/or the respective transport speed for the next rolled product delivered by the pinch roll.

15 Claims, 3 Drawing Sheets

(51) Int. Cl.
*B21B 1/08* (2006.01)
*B21B 1/16* (2006.01)

(56) References Cited

FOREIGN PATENT DOCUMENTS

| | | | |
|---|---|---|---|
| KR | 10-2004-0059135 | A | 7/2004 |
| WO | WO 2005/123293 | A1 | 12/2005 |
| WO | PCT/US2014/072672 | | 12/2014 |

OTHER PUBLICATIONS

International Preliminary Report on Patentability dated Jul. 4, 2017 in corresponding International Patent Application No. PCT/US2014/072672.
Notification Concerning Transmittal of International Preliminary Report on Patentability dated Jul. 13, 2017 in corresponding International Patent Application No. PCT/US2014/072672.
English Language International Search Report for PCT/US2014/072672; dated Mar. 25, 2015.

* cited by examiner

SLIDING TRANSPORT OF ROLLED PRODUCT WITH ADAPTATION OF FRICTION

CROSS REFERENCE TO RELATED APPLICATIONS

This application is based on and hereby claims priority to International Application No. PCT/US2014/072672 filed on Dec. 30, 2014, the contents of which are hereby incorporated by reference.

BACKGROUND

A starting point is a control method for a pinch roll for delivering rolled products, wherein the pinch roll delivers a respective rolled product, wherein a control device for the pinch roll opens the pinch roll at a respective trigger time and at a respective transport speed of the respective rolled product.

A further starting point is a computer program comprising program code which is executable by a control device for a pinch roll wherein executing the program code by the control device effects the implementation of such a control method.

A further starting point is a control device for a pinch roll wherein the control device is programmed with such a computer program so that the control device controls the pinch roll according to such a control method.

A further starting point is a transport device for delivering a rolled product, wherein the transport device comprises an openable pinch roll for transporting rolled products, wherein the transport device comprises a control device of the above-mentioned type.

After rolling a product—especially a bar-shaped product—the rolled product in many cases is delivered by a pinch roll to a cooling bed where it cools down. During cooling and after cooling the rolled product is transported in a direction rectangular to the previous direction of transport. Then the rolled product is processed further. To enable an easy further processing, the rolled products should be positioned on the cooling bed in a defined position.

In the related art, an operator determines the correct trigger time and/or the correct transport speed. Especially, the operator issues an opening command to the control device. In response to the opening command, the control device opens the pinch roll. The method of the related art requires an experienced operator to achieve good results.

SUMMARY

It is an object to position the rolled products in a defined position on said cooling bed in a simple, efficient, and reliable manner.

The inventor proposes a control method of the above-mentioned type is augmented by the following that said control device determines said respective trigger time and/or said respective transport speed using a model in dependency on a coefficient of friction used by the model, that, after opening said pinch roll, a measuring device detects iteratively a position or a derivation in time of the position of the respective rolled product, that said detected positions or said detected derivations in time of the position are provided to said control device, and that said control device in dependency on said detected positions or said detected derivations in time of the position of the respective rolled product updates said coefficient of friction and uses said updated coefficient of friction for determining the respective trigger time and/or the respective transport speed for the next rolled product delivered by the pinch roll.

Thus, the control device determines in dependency of the coefficient of friction by a model the respective trigger time and/or the respective transport speed. According to the inventor's proposal, further, in dependency on said detected positions or said detected derivations in time of the position of the respective rolled product the coefficient of friction is updated. Therefore it is possible not only to adapt the sliding movement of the rolled product. It is further possible to adapt the model to the real behaviour of the rolled product. The model is learning the actual behaviour of the rolled product.

The rolled products may be plate. Preferably, however, the rolled products are bar-shaped. They may have a profile, for example a T-profile, an I-profile, a double-T-profile, a X-profile, an U-profile, and so on.

In a preferred embodiment of the control method, said measuring device detects said positions or said derivations in time of the position without contacting the respective rolled product. Especially, said measuring device may be a optical measuring device, for example a laser gauge meter.

In a further preferred embodiment, the measuring device or an additional measuring device detects a respective final position of the respective rolled product. In this case, the respective final position is provided to the control device, and the control device updates the coefficient of friction in further dependency on the respective final position of the respective rolled product.

According to the inventor's proposal, executing a computer program effects the implementation of the proposed control method.

According to the inventor's proposal, the control device is programmed with a computer program so that the control device controls the pinch roll according to the proposed control method.

According to the inventor's proposal, the transport device comprises a measuring device for after opening said pinch roll iteratively detecting a position or a derivation in time of position of said rolled product, and the control device being adapted to control the pinch roll according to the proposed control method.

BRIEF DESCRIPTION OF THE DRAWINGS

The features, properties and advantages will be understood more easily by the following description of preferred embodiments which are explained in combination with the drawings. In the attached drawings:

As shown in FIG. 1, a transport device for transporting rolled products 1 comprises a pinch roll 2. The rolled products 1 may be rod-shaped, especially. By the pinch roll 2 a respective of the rolled products 1 is delivered. The pinch roll 2 may—in accordance to a control signal from a control device 3—be opened and closed. FIG. 2 shows the pinch roll 2 in its closed state. In this state, rolls of pinch roll 2 contact the respective rolled product 1 under pressure. The respective rolled product 1 is therefore delivered according to the circumferential speed of the rolls of the pinch roll 2. FIG. 3 shows the pinch roll 2 in its opened state. In this state, the rolls of the pinch roll 2 do not contact the respective rolled product 1. The movement of the respective rolled product 1 therefore is independent of the circumferential speed of the rolls of the pinch roll 2.

Figure 1:
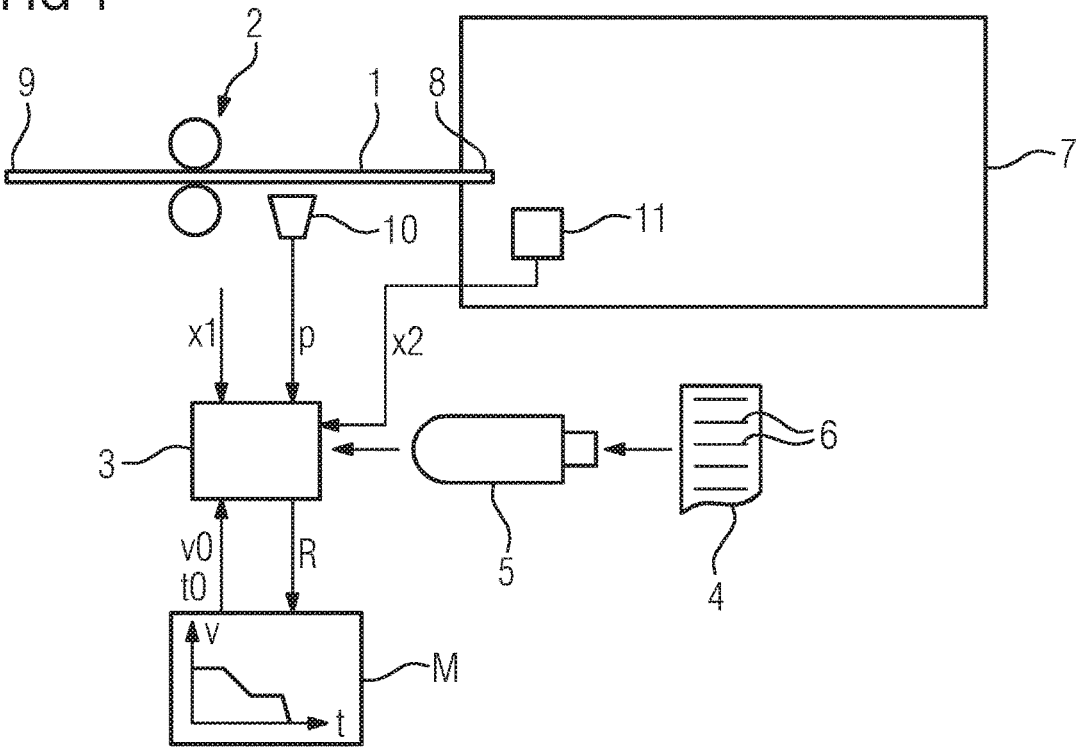
FIG. 1 shows a transport device.
Figure 2:
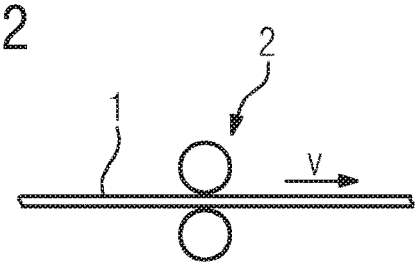
FIG. 2 shows a pinch roll in a closed state.
Figure 3:
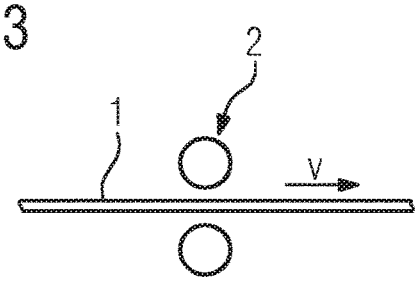
FIG. 3 shows the pinch roll of FIG. 2 in an opened state.

The control device 3 is programmed by a computer program 4. The computer program 4 may be provided to the control device 3 for example via a data carrier 5 on which the computer program 4 is stored in machine-readable form, for example in electronic form. The computer program 4 comprises machine code 6 executable by the control device 3. By executing the machine code 6, the control device 3 operates the pinch roll according to a control method which will be explained in detail below.

The respective rolled product 1 shall be delivered by the pinch roll 2 in a way that it stops on a surface 7 at a predetermined position. The surface 7 may be a cooling bed, for example. The predetermined position may be characterised for example by the fact that after stopping a head end of the respective rolled product 1 is positioned at a predetermined forward final position x1. Alternatively, the predetermined position may be characterised for example by the fact that after stopping a tail end of the respective rolled product 1 is positioned at a predetermined rear final position x2. Other embodiments are possible.

For achieving the respective positioning, the respective rolled product 1 is delivered by the pinch roll 2. At a respective trigger time t0 the control device 3 opens the pinch roll 2. At the trigger time t0 the respective rolled product 1 has a respective transport speed v0. Due to its inertia the respective rolled product 1 slides upon the surface 7. The speed v of the respective rolled product 1, however, decreases due to friction between the respective rolled product 1 and the surface 7. After some time and after moving a certain distance, the rolled product 1 therefore stops.

Figure 4:
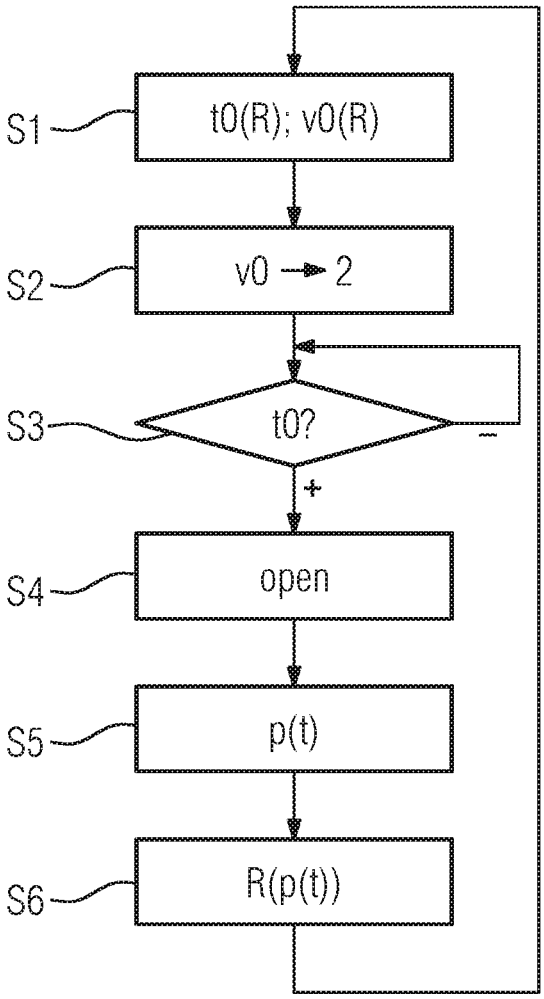
FIG. 4 shows a first flowchart.

As shown in FIG. 4, the control device 3 determines in S1 the respective trigger time t0 and the respective transport speed v0 in dependency on a coefficient R of friction in a coordinated manner. Coordination is such that assuming the coefficient R of friction is correct the respective rolled product 1 is positioned on the surface 7 as desired. Especially, the control device 3 determines by using a model M the trigger time t0 and the transport speed v0 a position at which the respective rolled product 1 stops. For example, the control device 3 may determine by using the model M an calculated final position at which a head end 8 of the respective rolled product 1 or a tail end 9 of the respective rolled product 1 stops. Model M models the sliding of the respective rolled product 1 on the surface 7. Model M uses and is dependent on (inter alia) the coefficient R of friction.

It is possible that the transport speed v0 is predetermined and not varied. In that case, in S1 exclusively the trigger time t0 is determined. Alternatively, it is possible that the trigger time t0 is predetermined and not varied. In that case, in S1 exclusively the transport speed v0 is determined. Alternatively, it is possible that both the trigger time t0 and the transport speed v0 are varied. In that case, in S1 both values t0, v0 are determined.

According to the determination in S1 the control device 3 controls in S2 the pinch roll 2 such that the circumferential speed of the rolls of the pinch roll 2 corresponds to the transport speed v0. In S3, the control device 3 checks whether the trigger time t0 is reached. When the trigger time t0 is reached, the control device 3 in S4 opens the pinch roll 2.

As shown in FIG. 1, the transport device further comprises a measuring device 10. By the measuring device 10 iteratively—for example each 10 ms—the position p of the respective rolled product 1 is detected. Detection occurs at least after opening of pinch roll 2. The measuring device 10 provides the detected positions p to the control device 3. The detected positions p are input into the control device 3 in S5. Alternatively or additionally to a detection of positions p there may be iteratively a detecting of a derivation in time of the position p, including providing the detected derivation to the control device 3. For example, by the measuring device 10 there may be detected directly the instantaneous speed v (=first derivation in time of position p). Alternatively, there may be detected directly the acceleration (=second derivation in time of position p).

The measuring device 10 may be as required. Preferably, the measuring device 10 is construed in a manner that it is able to detect the positions p or the derivations in time of the position p without contacting the respective rolled product 1. The measuring device 10 may be an optical measuring device, for example. Examples of such measuring devices are an optical camera, an infrared camera, a CCD-camera and so on. Especially preferred is that the measuring device 10 is a laser gauge meter. The measuring device 10 may work according to the Doppler-effect.

In S6, the control device 3 updates the coefficient R of friction. Updating is done in dependency on the detected positions p or the detected derivations in time of position p of the respective rolled product 1. After updating said coefficient R of friction, the control device 3 continues with S1. When executing S1 this time, however, of course not the rolled product 1 considered up to now is delivered. Instead, the next rolled product 1 is delivered. Due to the actualisation of the coefficient R of friction, the control device 3 uses for determining of trigger time t0 and/or transport speed v0 of the next delivered rolled product 1 the updated coefficient R of friction, however.

As shown in FIG. 1, in a preferred embodiment additionally a final position x1, x2 at which the respective rolled product 1 stops is detected. Detection may be done by the measuring device 10. Alternatively, detection may be done by an additional measuring device 11. The additional measuring device 11 may be—in anology to measuring device 10—such that it detects the respective final position x1, x2 without contacting the respective rolled product 1. For example, the additional measuring device 11 may be—in anology to measuring device 10—and optical measuring device. The disclosure given above with respect to the measuring device 10 applies also to the additional measuring device 11.

Figure 5:
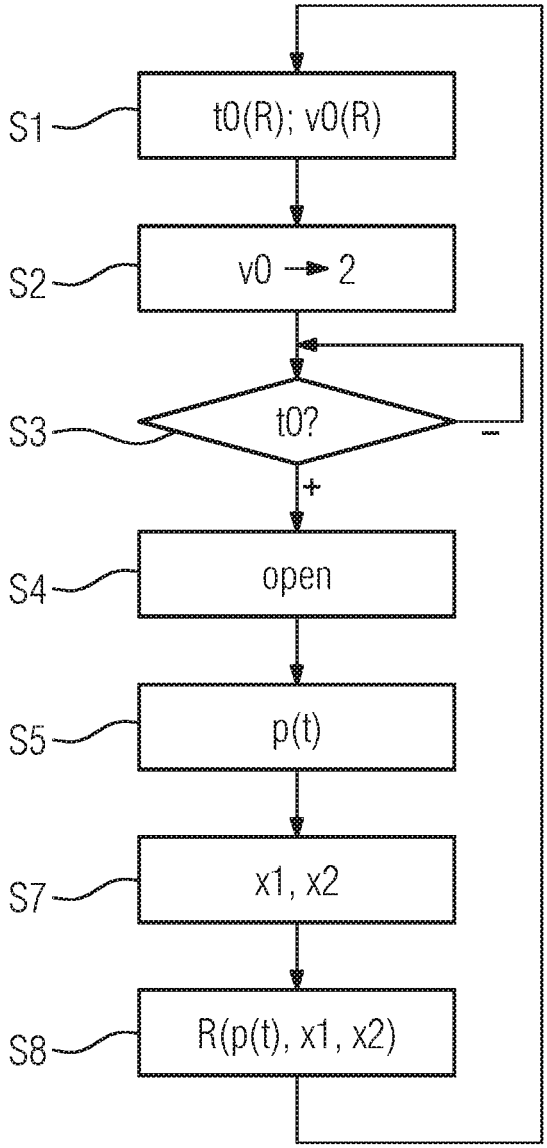
FIG. 5 shows a second flowchart.

In case the final position x1, x2 is detected, the method shown in FIG. 4 is modified as shown in FIG. 5.

FIG. 5 comprises steps S1 to S5 of FIG. 4. Steps S1 to S5 were explained already. Further, as shown in FIG. 5, there is also S7. In S7, the respective final position x1, x2 is provided to the control device 3. Further, S6 is replaced by S8. In S8, the control device 3 updates—in anology to S6 of FIG. 4—the coefficient R of friction. In contrast to S6, the control device 3 in S8 additionally to the detected positions p or the detected derivations in time of position p also takes in account the respective final position x1, x2 of the respective rolled product 1.

In short, therefore, the inventor's proposal concerns the following subject matter:

A pinch roll 2 delivers a respective rolled product 1. A control device 3 for the pinch roll 2 opens the pinch roll 2 at a respective trigger time t0 and at a respective transport speed v0 of the respective rolled product 1. The control device 3 determines said respective trigger time t0 and/or said respective transport speed v0 using a model M in dependency on a coefficient R of friction used by the model M. After opening said pinch roll 2, a measuring device 10 detects iteratively a position p or a derivation in time of the position p of the respective rolled product 1. The detected positions p or said detected derivations in time of the position p are provided to said control device 3. The control device 3 in dependency on said detected positions p or said detected derivations in time of the position p of the respective rolled product 1 updates said coefficient R of friction and uses said updated coefficient R of friction for determining the respective trigger time t0 and/or the respective transport speed v0 for the next rolled product 1 delivered by the the pinch roll (2).

The inventor's proposal has many advantages. Most importantly, automatic determination of trigger time t0 and/or transport speed v0 results in a reproducible, deterministic behaviour of rolled products 1. Further, due to updating the coefficient R of friction positioning of rolled products 1 may be improved continuously.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide* v. *DIRECTV,* 69 USPQ2d 1865 (Fed. Cir. 2004).

The invention claimed is:

1. A control method for a pinch roll that delivers a plurality of rolled products on a cooling bed, comprising:

using the pinch roll to deliver each rolled product;

for each rolled product, using a control device to open the pinch roll at a respective trigger time and at a respective transport speed of the rolled product;

for each rolled product, after opening the pinch roll, using a measuring device to iteratively detect a position or a derivation in time of the position of the rolled product;

for each rolled product, providing to the control device the position detected or the derivation in time detected;

for each rolled product, using the control device to update a coefficient of friction between the rolled product and the cooling bed, the coefficient of friction being updated in dependency on the position detected or the derivation in time detected; and for a next rolled product to be delivered by the pinch roll, using the updated coefficient of friction to determine at least one of the respective trigger time and the respective transport speed for the next rolled product, the at least one of the respective trigger time and the respective transport speed being determined based on a model that depends on the updated coefficient of friction between the rolled product and the cooling bed.

2. The control method according to claim 1, wherein the rolled products are bar-shaped rolled products.

3. The control method according to claim 2, wherein the measuring device detects the position or the derivation in time without contacting the rolled product.

4. The control method according to claim 3, wherein the measuring device is an optical measuring device.

5. The control method according to claim 4, wherein the measuring device is a laser gauge meter.

6. The control method according to claim 1, wherein the measuring device detects the position or the derivation in time without contacting the rolled product.

7. The control method according to claim 6, wherein the measuring device is an optical measuring device.

8. The control method according to claim 7, wherein the measuring device is a laser gauge meter.

9. The control method according to claim 1, further comprising:

for each rolled product, detecting a final position of the product; and for each rolled product, providing the final position to the control device, wherein in addition to the position detected or the derivation in time detected, the control device updates the coefficient of friction for each rolled product in dependency on the final position.

10. The control method according to claim 1, further comprising:

for each rolled product, detecting a final position of the rolled product; and for each rolled product, providing the final position to the control device, wherein in addition to the position detected or the derivation in time detected, the control device updates the coefficient of friction for each rolled product in dependency on the final position.

11. The control method according to claim 1, wherein the control device determines both the respective trigger time and the respective transport speed based on the model.

12. A control device comprising:

at least one processor, configured to execute the instructions stored in the memory to:

open a pinch roll that delivers a plurality of rolled products on a cooling bed, the pinch roll being opened for each rolled product, the pinch roll being opened at a respective trigger time and at a respective transport speed of the rolled product;

iteratively detect, for each rolled product, a position of the rolled product or a derivation in time of the position of the rolled product, the position or the derivation in time being detected for each rolled product after opening the pinch roll;

determine, for each rolled product, an updated coefficient of friction between the rolled product and the cooling bed, the coefficient of friction being updated in dependency on the position detected or the derivation in time detected; and use the updated coefficient of friction for a next rolled product to be delivered by the pinch roll, to determine at least one of the respective trigger time and the respective transport speed for the next rolled product, the at least one of the respective trigger time and the respective transport speed being determined based on a model that depends on the updated coefficient of friction between the rolled product and the cooling bed.

13. A transport device for transporting rolled products, comprising:

a pinch roll that delivers a plurality of rolled products on a cooling bed;

a measuring device to iteratively detect, for each rolled product, a position or a derivation in time of the position of the rolled product, the position or the derivation in time of the position being detected after opening the pinch roll; and a control device comprising:

at least one processor, configured to:

open the pinch roll for each rolled product, the pinch roll being opened at a respective trigger time and at a respective transport speed of the rolled product;

determine, for each rolled product, an updated coefficient of friction between the rolled product and the cooling bed, the coefficient of friction being updated in dependency on a position of the rolled product or a derivation in time of the position of the respective rolled product; and use the updated coefficient of friction for a next rolled product to be delivered by the pinch roll, to determine at least one of the respective trigger time and the respective transport speed for the next rolled product, the at least one of the respective trigger time and the respective transport speed being determined based on a model that depends on the updated coefficient of friction between the rolled product and the cooling bed.

14. The transport device according to claim 13, wherein the control device determines both the respective trigger time and the respective transport speed based on the model.

15. The control device according to claim 12, wherein the control device determines both the respective trigger time and the respective transport speed based on the model.

* * * * *